US009656139B2

(12) United States Patent
Stanley et al.

(10) Patent No.: US 9,656,139 B2
(45) Date of Patent: May 23, 2017

(54) TOWEL DRILL DEVICE AND METHOD OF MAKING SAME

(71) Applicant: STEAMER46, LLC, Stratham, NH (US)

(72) Inventors: Robert William Stanley, Stratham, NH (US); Frederick Silliman Dolce, Stratham, NH (US); Fran Anthony Piascik, Bedford, NH (US); Kyle Robert Stanley, Maynard, MA (US)

(73) Assignee: Steamer46, LLC, Stratham, NH (US)

( * ) Notice: Subject to any disclaimer, the term of this patent is extended or adjusted under 35 U.S.C. 154(b) by 0 days.

(21) Appl. No.: 14/887,368

(22) Filed: Oct. 20, 2015

(65) Prior Publication Data

US 2017/0106263 A1 Apr. 20, 2017

(51) Int. Cl.

| | |
|---|---|
| ***A63B 69/00*** | (2006.01) |
| ***A63B 43/00*** | (2006.01) |
| ***A63B 37/00*** | (2006.01) |
| ***A63B 45/00*** | (2006.01) |

(52) U.S. Cl.

CPC ..... *A63B 69/0002* (2013.01); *A63B 43/00* (2013.01); *A63B 45/00* (2013.01)

(58) Field of Classification Search

CPC ..... A63B 71/00; A63B 43/02; A63B 43/00; A63B 43/007; A63B 65/02; A63B 69/0002; A63B 45/00; A01K 15/026

USPC ..... 473/575, 571, 594, 576, 451, 450, 458, 473/464, 423, 422; D21/436, 707, 597, D21/712, 698, 788

See application file for complete search history.

(56) References Cited

U.S. PATENT DOCUMENTS

| | | | | | |
|---|---|---|---|---|---|
| 3,368,815 | A | | 2/1968 | Alabastro | |
| 3,393,911 | A | | 7/1968 | Lawson | |
| 4,088,319 | A | | 5/1978 | Clarke | |
| 4,266,781 | A | | 5/1981 | Blue | |
| 4,294,447 | A | | 10/1981 | Clark | |
| 4,657,253 | A | * | 4/1987 | Lerner | A63B 43/02 473/576 |
| 4,696,472 | A | * | 9/1987 | Meyer | A63B 43/02 473/575 |
| 4,826,179 | A | | 5/1989 | Callaghan | |
| 5,112,061 | A | * | 5/1992 | Lamle | A63B 37/08 473/473 |
| D356,354 | S | * | 3/1995 | Killion | D21/436 |

(Continued)

FOREIGN PATENT DOCUMENTS

| | | | | | |
|---|---|---|---|---|---|
| GB | 2051586 | A | * | 1/1981 | A63B 43/00 |

*Primary Examiner* — Mitra Aryanpour

(74) *Attorney, Agent, or Firm* — Mesmer & Deleault PLLC

(57) ABSTRACT

A sports training device for pitching and throwing has a ball core and a cover material. The core member defines a passageway extending through the ball core and also defines an anchor recess into a surface of the ball core. The anchor recess is aligned with and communicates with the passageway. A cloth member has a geometric shape with at least one corner and defining an attachment portion and a body portion extending away from the attachment portion. The attachment portion extends through the passageway and is attached to an anchor member sized to be received in the anchor recess. A cover material is installed over the ball core with the body portion of the cloth member extending through a cover opening and out from the ball core.

19 Claims, 6 Drawing Sheets

(56) References Cited

U.S. PATENT DOCUMENTS

| | | | | |
|---|---|---|---|---|
| 5,551,687 | A * | 9/1996 | Krull | A63B 43/007 473/573 |
| D396,256 | S * | 7/1998 | Shaw | D21/707 |
| 5,813,931 | A | 9/1998 | Gormely | |
| 5,830,091 | A | 11/1998 | Romanick | |
| 6,024,660 | A | 2/2000 | Romanick | |
| D480,902 | S * | 10/2003 | Long | D21/466 |
| 6,651,497 | B2 | 11/2003 | Imatoh | |
| D500,424 | S * | 1/2005 | Long | D21/466 |
| 6,884,187 | B2 | 4/2005 | Cataldi, Jr. et al. | |
| 7,100,539 | B2 * | 9/2006 | Levan | A01K 15/026 119/707 |
| 7,247,106 | B1 | 7/2007 | Brandt | |
| D578,585 | S * | 10/2008 | Bramble | D11/165 |
| 7,563,183 | B2 | 7/2009 | Kucek | |
| 7,753,811 | B2 | 7/2010 | Mark | |
| 7,951,020 | B2 | 5/2011 | Castor | |
| D661,848 | S * | 6/2012 | Byrne | D30/160 |
| 8,197,363 | B1 | 6/2012 | Davignon | |
| 8,439,774 | B2 | 5/2013 | Massey | |
| 8,668,602 | B1 * | 3/2014 | Kieffaber | A63B 65/02 473/417 |
| 8,684,868 | B2 | 4/2014 | Fountain | |
| 8,708,843 | B1 | 4/2014 | Sekac | |
| 8,771,106 | B1 | 7/2014 | Boulanger et al. | |
| 9,149,699 | B2 | 10/2015 | Tai | |
| 9,266,001 | B1 * | 2/2016 | Leon | A63B 69/0002 473/450 |
| 2004/0033849 | A1 | 2/2004 | Hunter | |
| 2006/0135291 | A1 | 6/2006 | Biegen | |
| 2007/0105663 | A1 | 5/2007 | Farnsworth | |
| 2007/0135242 | A1 | 6/2007 | Schoonover | |
| 2010/0255939 | A1 | 10/2010 | York | |
| 2014/0135151 | A1 | 5/2014 | Johnston | |
| 2014/0228157 | A1 | 8/2014 | Johnston | |
| 2015/0217178 | A1 * | 8/2015 | Fisher | A63B 71/00 273/317 |

* cited by examiner

TOWEL DRILL DEVICE AND METHOD OF MAKING SAME

BACKGROUND OF THE INVENTION

1. Field of the Invention

The present invention relates generally to sporting goods and training equipment. More particularly, the present invention relates to a training device for throwing and pitching a ball.

2. Description of the Prior Art

In baseball and related sports, a proper throwing motion is important in order to have power, movement on the ball, and accuracy in addition to preventing injury.

When a pitcher practices arm motion, position, and speed, the pitcher typically throws a baseball or softball towards a target, which may be a catcher or a backstop. For such practice, the pitcher must be positioned a sufficient distance from the target. Due to space limitations, this type of pitching practice often cannot be performed indoors. Moreover, a pitching coach should be present to watch the pitcher to critique and adjust the pitcher's arm motion, position, and speed during practice pitches. Absent a coach, a video camera may be used to record practice pitches and later reviewed to examine the fundamentals of the pitcher's arm movement.

In addition to using repetition and practice with a game ball, trainers and coaches have taught and improved throwing mechanics with the use of a variety of training aids. A method traditionally used to teach throwing mechanics is for the player to grip one end of towel in the hand and perform the throwing motion while extending the towel forward toward the target. This exercise traditionally is known as the "towel drill." The difficulty and limitations of the traditional towel drill have led to the desire for alternate training devices.

One training aid is disclosed in US patent application publication no. 2007-0135242 to Schoonover. The Schoonover published application discloses a baseball and softball pitching aid that emits an audible cracking sound to confirm to the pitcher that he or she has achieved the desired arm motion, speed, and elbow position during a practice pitch. The device includes a real or replica baseball (or softball) with an attached flexible flap made of made of leather, vinyl, cloth, or the like. Pairs of slotted holes extend through the baseball and are positioned adjacent to the seams around the baseball. To secure the flexible flap to the baseball, a connecting strap loops through one end of the flexible flap, through the slotted holes, and attaches to itself on the opposite side of the ball. Alternately, the strap may wrap around the outside of the ball. The flexible flap is adapted to emit an audible cracking sound in response to arm acceleration generated by the pitcher during the final stage of a practice pitch just prior to the follow-through.

U.S. Pat. No. 8,771,106 to Boulanger et al. discloses a training and rehabilitation device for ball throwing. A tether or rope is attached to a retention mechanism inserted into one of several blind holes pre-drilled through the surface into a ball. The retention mechanism has a cylindrical plug with ribs, a notch, or other key fitting member that engages the blind hole. The plug may be selectively removed from one pre-drilled hole and installed into another pre-drilled hole at a different location on the ball for different finger placement on the ball. The retention mechanism also has an elongated plastic shaft extending from the cylindrical plug. The tether or frayed rope is connected to the distal end of the plastic shaft. The tether or rope is between 20 and 60 inches in length and may be secured to the plastic shaft with shrink tubing.

SUMMARY OF THE INVENTION

The above-described devices have several limitations and disadvantages. The traditional towel drill is inconsistent and difficult to implement due to the need to grasp and hold a portion of a towel in the player's hand throughout the throwing motion and without releasing the towel. Since the towel is not shaped to be gripped as such, the player often grabs different amounts of the towel, resulting in different feel and effectiveness in refining the throwing motion. Further, the need to strongly grasp the towel requires a different group of muscles be at tension during the throwing motion. These muscles used to grasp and hold the towel would not ordinarily be tense when throwing and releasing a ball. When the first is clenched around a towel, the tightened muscles negatively affect the performance and control of other muscles used in the throwing motion and therefore reinforces undesirable technique. As a general matter, refined movement developed through repetition involves muscle memory. Training devices that require muscle contractions that are unnecessary or unhelpful to the throwing motion reinforce an undesirable muscle memory for the throwing motion.

Some players have attempted to wrap the end of a towel around the surface of a baseball and then perform the towel drill. This approach has resulted in rapid arm fatigue due to the increased weight of the towel and ball compared to the baseball alone and due to the increased size of the ball. Also, this approach still requires the player to strongly grip the towel and ball together throughout the throwing motion. Further, players have difficulty in replicating a consistent towel drill setup when the towel is not secured to a ball. When wrapped around the ball, the towel extends from the ball in varying lengths and shapes, resulting in varying performance. Also, the player must strive to have the same towel available for consistent weight and feel.

Other training devices have not satisfactorily solved the problems of the traditional towel drill. The Schoonover device has many openings that undesirably affect the surface and therefore the pitcher's feel on the ball. The strap wrapping through and around the ball also interferes with the pitcher's grip on the ball because it is located where the pitcher's fingers are placed. Further, the strap does not securely attach the flexible flap to the ball during the throwing motion, resulting in the flap separating from the ball. Still further, the frayed rope attachment on the Boulanger device does not adequately trap air during flight and therefore does not create a fanning effect and air resistance during the throwing motion. In sum, some pitchers find the feel of the Schoonover device unappealing and less effective for warming up or for improving one's pitching and throwing.

The audible cracking sound of the Schoonover device is tailored to a narrow range of acceptable throwing path, mechanics, leverage, or arm motion. Since the Schoonover device uses a replica baseball or a regulation baseball, the size and weight of the device is intended for use by adults. A regulation baseball is between 142-149 grams and has a circumference of 9-9.25 inches. As a result, children and young players risk straining the arm and shoulder by using the Schoonover device that is based on a regulation baseball. Also, since each player is different in body size, shape, and strength, a proper arm motion of one player may not create the audible crack observed by the proper arm motion of other players. Particularly, the motion needed to generate the cracking sound cannot be accomplished by a child's throwing motion. Thus, the Schoonover device is not designed to be an effective training aid for all players from young children up through professional baseball players.

The Boulanger et al. training device is undesirable to use due to the elongated plastic shaft extending from the ball. Also, the rope attached to the plastic shaft is uncomfortably long and does not provide adequate resistance to simulate the throwing motion used when actually throwing a ball. Additionally, the user of the Boulanger et al. training device must unscrew the rope assembly and reinstall it in different holes in the ball when switching between various pitches. For these reasons, the "feel" of the Boulanger et al. device is also undesirable and less effective as a training device for pitching and throwing.

The deficiencies of the training devices discussed above resulted in the need for an improved training device for throwing and pitching. Accordingly, it is an object of the present invention to provide an effective training device useful for warming up and for improving one's throwing or pitching skills.

It is another object of the present invention to provide a training device for use by pitchers of various size, age, and throwing ability.

It is another object of the present invention to provide a training device for throwing and pitching that does not require additional equipment or a training partner.

The present invention achieves these and other objectives by providing a training device for throwing and pitching that includes a ball with a cloth member securely attached to the ball and extending from one side of the ball.

One aspect of the invention is a sports training device for pitching and throwing. In one embodiment, the training device includes a ball core having a substantially spherical shape and defining a passageway extending through the ball core. The ball core defines an anchor recess in a surface of the ball core and that extends transversely to and communicates with the passageway. An anchor member is received in the anchor recess. A cloth member is attached to the anchor member, such as by wrapping over the longitudinal portion. For example, the cloth member has a geometric shape defining an attachment portion and a body portion extending away from the attachment portion and having at least one corner. The attachment portion extends into or through the passageway and is attached to the anchor member. A cover material is disposed over the ball core so that the body portion of the cloth member extends out through the passageway and the cover member. For example, the cover member has a cover opening opposite of the anchor recess and aligned over the passageway.

In another embodiment, the anchor member has a longitudinal portion that is received in the anchor recess. The attachment portion may be attached to the anchor member by wrapping over or around the longitudinal portion of the anchor member and then being fixedly attached to itself.

In another embodiment, the anchor member is a rod, a bar, a hook, or a T-shaped object.

In another embodiment, the attachment portion extends through an opening defined in the anchor member. In some embodiments, the attachment portion of the cloth member is one of the corners of the cloth member. In other embodiments, the attachment portion of the cloth member is a length or strip of material extending from the body portion.

In another embodiment, the cloth member is made of cotton denim and has an area between about 230 and 250 square inches. For example, the cloth member is 10-oz cotton denim rectangle that has a size of approximately 12"×20".

In another embodiment, the ball core with attached cover material has a circumference of about 7.5 inches. In another embodiment, the assembled training device weighs less than 140 grams.

In another embodiment, the bore is a blind bore into the ball core, where the attachment portion is wrapped with string and retained in the bore with an adhesive. In such an embodiment, the adhesive functions as the anchor member.

Another aspect of the invention is a method of making a sports training device. In one embodiment, the method includes the steps of providing a ball core, a cloth member having an attachment portion and a body portion, an anchor member, and a cover member with a cover opening; defining a passageway through the ball core; defining an anchor recess in the surface of the ball core, where the anchor recess is aligned with and communicates with the passageway; inserting the attachment portion of the cloth member through the passageway in the ball core; attaching the attachment portion to the anchor member; seating the anchor member in the anchor recess with the attachment portion attached thereto and with the body portion of the cloth member extending out through the passageway and away from the ball core; and installing the cover member over the ball core, where the body portion of the cloth member extends out through the cover opening.

In another embodiment of the method, attaching the attachment portion to the anchor member includes the steps of selecting the attachment portion as a corner portion of the cloth member, wrapping the attachment portion around the anchor member, and securing the attachment portion to itself.

In another embodiment of the method, attaching the attachment portion to the anchor member includes wrapping the attachment portion with string, disposing a quantity of adhesive into the bore, and inserting the wrapped attachment portion into the bore, where the adhesive is the anchor member that secures the attachment portion into the bore. In some embodiments, the bore is a blind bore.

In another embodiment, the method also includes wrapping string or wire around the anchor member and the attachment portion after wrapping attachment portion around the anchor member. By doing so, the string or wire reinforces the attachment of the cloth member to the anchor member.

In another embodiment, the corner portion is selected to include a cloth strip or tab extending across the corner portion, where the step of wrapping the attachment portion around the anchor member includes positioning the anchor member between the cloth strip and the corner portion.

In another embodiment, the providing step includes selecting the anchor as a bar, a rod, a T-shaped object, or a hook. In another embodiment, the providing step includes selecting the cloth member to be made of cotton denim and having an area from about 230 to about 250 square inches. In another embodiment, the providing step includes selecting the ball core and the cover member to result in a circumference of about 7.5 inches when the cover member is installed on the ball core. In yet another embodiment, the providing step includes selecting the ball core, the cloth member, the anchor member, and the cover member to result in an assembled weight of less than 140 grams.

In another embodiment, the cloth member is configured to extend from the ball core by about 18 to 22 inches.

In another embodiment, the method also includes the steps of inserting the attachment portion through a grommet, inserting the attachment portion through the cover opening defined in the cover member, and installing the grommet in the cover opening.

In another embodiment, the step of installing the cover member includes the steps of selecting the cover member that includes a cover member first portion and a cover member second portion, where the cover member first portion defines the cover opening; inserting the attachment portion through the cover opening prior to the step of inserting the attachment portion through the passageway; aligning the cover opening over the passageway and opposite of the anchor recess; and stitching together the cover member first portion to the cover member second portion, thereby forming a substantially continuous cover over the ball core.

DETAILED DESCRIPTION

Figure 1:
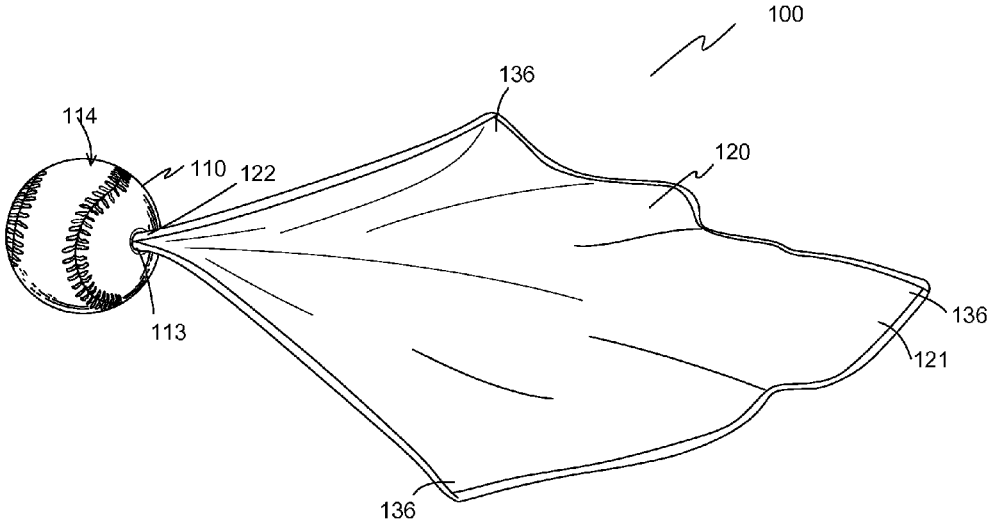
FIG. 1 illustrates a perspective view of one embodiment of a training device of the present invention.

Embodiments of the present invention are illustrated in FIGS. 1-8. FIG. 1 illustrates a perspective view of one embodiment of a training device 100 that includes a substantially spherical ball 110 and a cloth member 120 attached to ball 110 at an attachment portion 122. Cloth member 120 extends through a cover opening 113 through a cover material 114 on ball 110 and extends away from ball 110 to a distal end 121. In one embodiment, cloth member 120 is a single sheet of fabric or other material that is continuous across its dimensions without openings or cuts. This is unlike prior art streamers, frayed rope, or multiple strips of material that may be used in some throwing training devices. In one embodiment, cloth member 120 has at least two free corners 136 (i.e., not attached to ball 110.) In other embodiments, cloth member 120 has three, four, or five free corners 136. In one embodiment, distal end 121 coincides with one of the free corners 136.

Figure 2A:
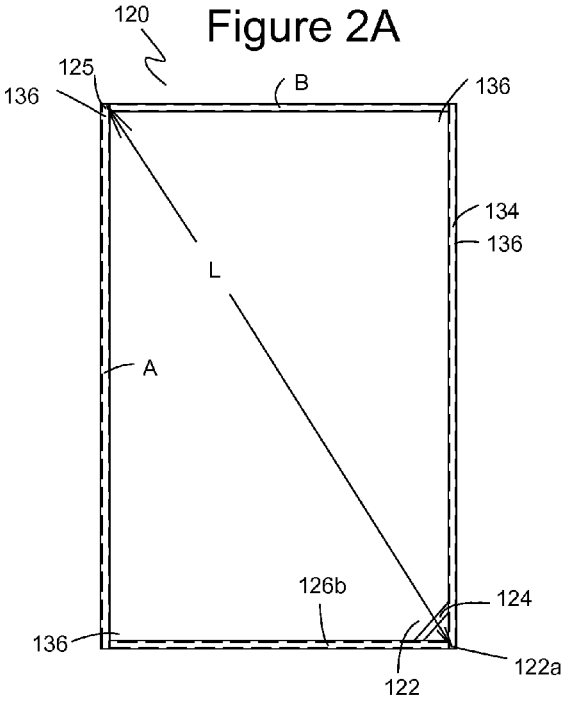
FIG. 2A illustrates a plan view of an embodiment of a cloth member of the training device of the present invention.
Figure 2B:
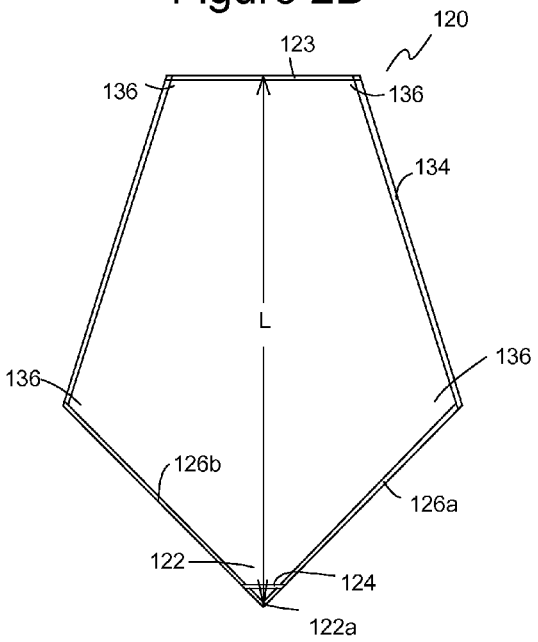
FIG. 2B illustrates a plan view of another embodiment of a cloth member of the present invention.

Referring now to FIGS. 2A and 2B, plan views illustrate exemplary embodiments of cloth member 120. In FIG. 2A, cloth member 120 has a rectangular shape; in FIG. 2B, cloth member 120 has a pentagonal shape. In both embodiments, the shape of cloth member 120 has attachment portion 122 for being secured to ball 110. In some embodiments, cloth member 120 includes a tab 124 extending diagonally across attachment portion 122 and spaced from attachment portion tip 122*a*. For example, tab 124 is a length of cloth tape about ½" wide that extends across attachment portion 122, where tab 124 is spaced about three inches from attachment portion tip 122*a*. In the embodiment of FIG. 2A, tab 124 is stitched to and secured by edges 126*a*, 126*b* adjacent attachment portion 122. Tab 124 is useful for attaching cloth member 120 to an anchor member 190, which is discussed in more detail below.

Cloth member 120 has a length L from attachment portion tip 122*a* to the furthest-located opposite edge 123 (as in FIG. 2B) or opposite corner 125 (as in FIG. 2A). That is, length L is the longest length in any direction from attachment portion tip 122*a* to an edge 123 or other corner 125 of cloth member 120. In one embodiment, cloth member 120 is a rectangle with a long side length A of 20 inches, a short side width B of 12 inches, and length L of about 23.3 inches from attachment portion tip 122*a* at one corner to the diagonally opposite corner 125. Optionally, the fabric edge is folded on itself to create a ¼-wide cloth member edge 134 to prevent fraying. For example, the folded edge is then secured with two lines of thread stitching 136 spaced approximately 3/16 inch apart. Tab 124 is spaced from attachment portion tip 122 by about 3.2 inches. Thus, with tab 124 and attachment portion 122 installed into ball 110, cloth member 120 has an overall length of about 21 inches from cover opening 113 to the distal end 121 of cloth member 120 (shown in FIG. 1), where the overall length from ball 110 typically is shorter than length L across cloth member 120. A rectangular shape is desirable because it has been shown to be effective in creating an adequate amount of aerodynamic drag that, combined with ball 110, approximates the throwing force used with a regulation baseball. Further, when one corner is used to attach to ball 110, the rectangular shape has three free corners 136 that create aerodynamic drag in different directions during flight through the air. These free corners 136 prevent cloth member 120 from overly spreading out during flight by pulling against the air in various directions. The result is that cloth member 120 does not excessively fan out and traps air to provide resistance to the throwing motion.

Figure 3:
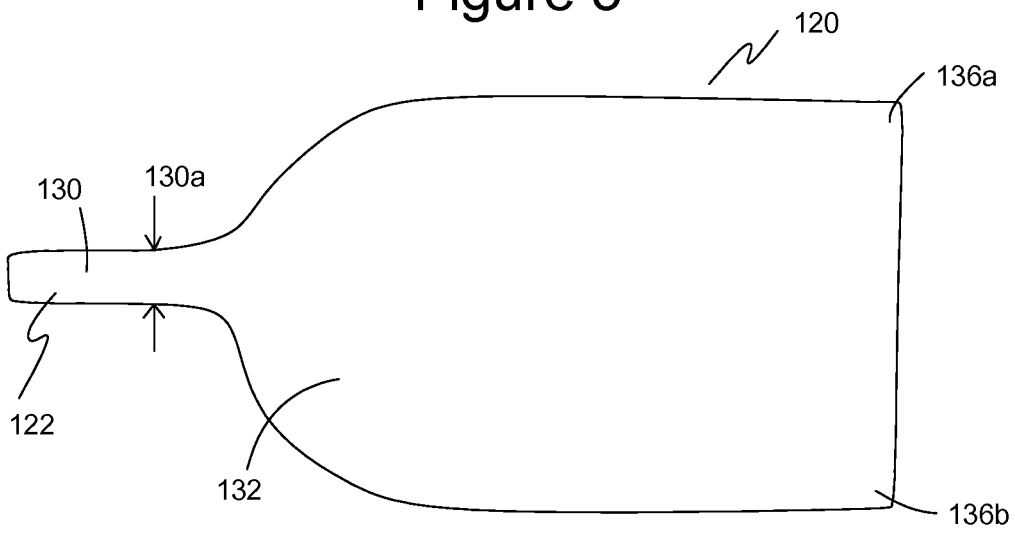
FIG. 3 illustrates a plan view of another embodiment of a cloth member of the present invention showing an attachment strip extending from a body portion of the cloth member.

Referring now to FIG. 3, a plan view illustrates another embodiment of cloth member 120 where attachment portion 122 is an attachment strip 130 extending from a body portion 132 of cloth member 120. Attachment strip 130 may be a narrowed portion of cloth member 120 or may be a separate piece of material fixedly attached to and extending from body portion 132 of cloth member 120. In either case, attachment strip 130 has a width 130*a* significantly less than that of body portion 132, where width 130*a* is sized to be inserted into a passageway or bore 166 through ball core 160 (shown in FIG. 4) and attach to an anchor member 190 (shown e.g., in FIGS. 7A-7H), features which are discussed below. As with attachment portion 122 that is a corner 136 of cloth member 120, attachment strip 130 may be used to secure cloth member 120 to anchor member 190 (e.g., a dowel pin, shown in FIG. 7B), such as by wrapping it around anchor member 190 and then seating anchor member 190 in anchor recess 168. Cloth member 120 as shown in FIG. 3 has at least two free corners 136*a*, 136*b*. As cloth member 120 travels through the air, these free corners 136*a*, 136*b* provide aerodynamic drag. This effect results from the various free corners 136 creating drag against the air during flight, where the drag force on each free corner 136 is believed to occur in different directions as cloth member 120 travels through the air.

In one embodiment, cloth member 120 has a weight of about 51 grams (about 1.8 oz.) and is made of cotton denim fabric weighing 10 oz./square yard. Weights of 45-55 grams and other weights for cloth member 120 are acceptable, depending on the desired training regimen. 10-oz cotton denim is chosen for its durability and for the resistance it provides to the throwing motion as it moves through the air. Being a relatively stiff fabric, but not overly stiff, the denim fabric substantially maintains a collapsed, collected shape and resists fanning out as it travels through the air. In contrast, stiffer fabrics tend to fan out during flight. Stiffer fabrics are also difficult to assemble with ball core 160 and anchor member 190. Lighter weight fabrics tend to trail behind the ball without fanning out, which results in failing to provide sufficient aerodynamic drag or sufficient weight desired by the user.

Cloth member 120 is intended to withstand numerous repetitive practice motions. Cloth member 120 is also intended to withstand more extensive and significant wear if the user chooses to hit or slap cloth member 120 against a stationary object, such as a chair, wall, fence, baseball bat, or baseball glove. A cotton denim fabric as discussed above has shown to be sufficiently durable for these uses, yet sufficiently pliable for assembly with ball 110, and also providing the desired aerodynamic drag. Cotton denim fabric also has the desired thickness and weight so that cloth member 120 need not extend more than about two feet from ball 110. In one embodiment, for example, cloth member 120 extends about 18 to 22 inches from ball 110.

In contrast to cloth member 120 as described herein, rope, plastic strips, nylon fabric and other materials either are too heavy, dense, or inflexible, or are too light, small, or wispy to provide adequate resistance (i.e., aerodynamic drag) to the user's throwing motion. When cloth member 120 includes too much fabric or has an overall length from ball 110 that is too long, cloth member 120 becomes unwieldy or provides too much resistance to mimic the user's throwing motion with a regulation baseball. Similarly, when cloth member 120 includes too little fabric or has an overall length from ball 110 that is too short, cloth member 120 provides too little resistance to mimic the user's throwing motion with a regulation baseball. Too much drag from cloth member 120 may strain the user's arm; too little drag from cloth member 120 may reinforce bad habits and improper technique. Specifically, training device 100 of the present invention is designed to teach or reinforce the proper follow through and movement at the end of the throwing motion. Devices having too little resistance accordingly fail to reinforce the important aspects of power and follow through at the end of the throwing motion.

Aerodynamic drag (air resistance) increases proportionally to airspeed for laminar flow and proportional to the square of velocity for turbulent flow. In either flow regime, arms of different lengths and throwing motions of different speeds therefore generate different amounts of drag due to cloth member 120 traveling through the air. This is unlike throwing a regulation baseball where the resistance to the throwing motion is a fixed value based on the mass of the ball. The training device 100 of the present invention utilizes a lighter and smaller ball 110 combined with cloth member 120 that allows training device 100 to provide varying amounts of resistance to the throwing motion due to the aerodynamic drag being dependent on the throwing speed. Thus, young players as well as adult professional players may benefit from warming up and training with training device 100.

Cloth member 120 made of cotton denim and sized as discussed above results in a mass, area, and overall length that provides a suitable resistance against the user's throwing motion. In other words, the force exerted by the user to move cloth member 120 through the air simulates the feel of throwing a regulation baseball, yet ball 110 and cloth member 120 together are lighter than a regulation baseball: in one embodiment, ball 110 and cloth member together weigh about 131 grams, which is less than the 142-149 grams of a regulation baseball. Cotton denim fabric is also desirable because it generates adequate, but not excessive aerodynamic drag as it is pulled through the air. Although this combination of performance and durability makes cotton denim fabric a desirable choice for cloth member 120, other materials available in sheet form are acceptable, such as chambray, leather, wool, and fabrics of natural and/or synthetic fibers.

Figure 4:
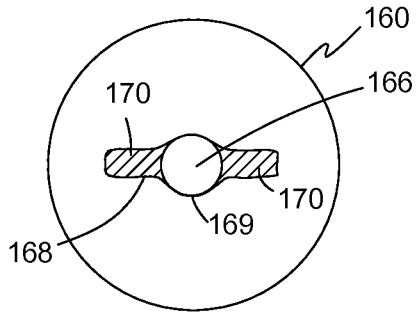
FIG. 4 illustrates an elevational view of one embodiment of a ball core of the present invention showing a passageway and anchor recess formed in the surface of the ball core.

Referring now to FIG. 4, one embodiment of ball core 160 is shown as viewed axially looking through passageway or bore 166 extending therethrough and at anchor recess 168 formed into a surface of ball core 160. Passageway or bore 166 is shown as having a circular cross-sectional shape, but any cross-sectional shape is acceptable provided that attachment portion 122 of cloth member 120 can be inserted therethrough. In one embodiment, ball core 160 is made of a cork and rubber mixture, which is heated to create the core material. For example, core 160 is made of 10% rubber and 90% cork, and wrapped with string. Anchor recess 168 aligns with and intersects bore 166. Preferably, anchor recess 168 is centered on and oriented perpendicular to bore 166 as viewed axially in FIG. 4. In one embodiment, anchor recess approximates an elongated oval shape with a middle portion 169 positioned coincident with bore 166. Optionally, middle portion 169 is wider compared to end portions 170. In one embodiment, middle portion 169 has a width about equal to the diameter of bore 166. These various shapes allow anchor recess 168 to receive anchor member 190 with cloth member 120 wrapped around it and extending through bore 166. In one embodiment, middle portion 169 of anchor recess 168 is enlarged to accommodate cloth member 120 being wrapped around the center of the anchor 190.

Figure 5:
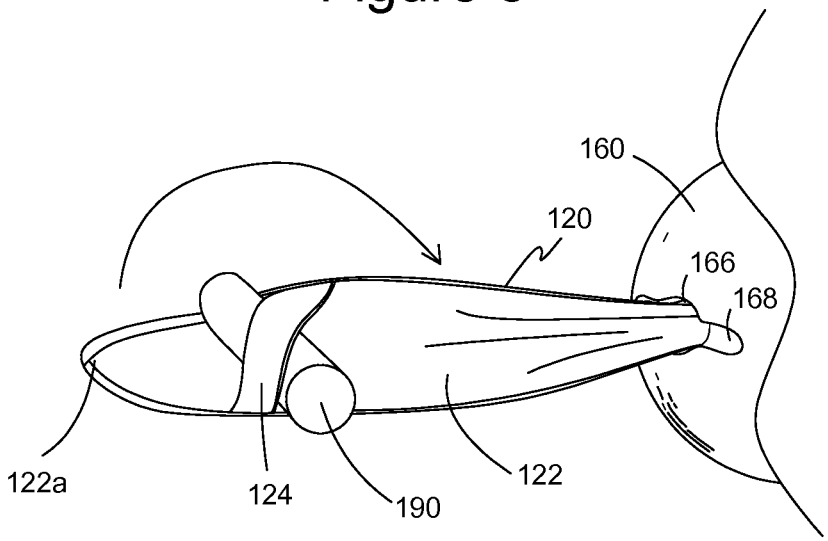
FIG. 5 illustrates a perspective view showing assembly of the cloth member to the anchor member and ball core.

Referring to FIG. 5, a perspective view shows attachment portion 122 of cloth member 120 positioned for assembly with one embodiment of anchor member 190 and ball core 160. Here, anchor member 190 is a dowel pin or the like, which is shown enlarged for clarity. Prior to attaching attachment portion 122 to anchor member 190, attachment portion is extended through bore 166 of ball core 160. Anchor member 190 is then oriented transversely to attachment portion 122. In embodiments of cloth member 120 that include tab 124, anchor 190 may pass between tab 124 and cloth member 120. Attachment portion tip 122*a* then may be folded over anchor member 190 and secured to attachment portion, such as by stitching and/or wrapping with string. Excess material of attachment portion 122 then may be pulled back through bore 166 and anchor member 190 seated in anchor recess 168 with attachment portion 122 secured thereto.

Figure 5A:
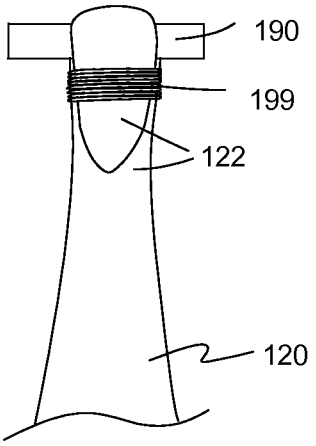
FIG. 5A illustrates an elevational view showing the cloth member wrapped over the anchor member and secured with string wrapped around the cloth member.
Figure 5B:
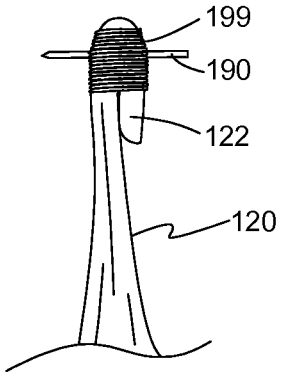
FIG. 5B illustrates an elevational view showing the cloth member wrapped with string and including the anchor member pierced through the wrapped portion.

Referring to FIG. 5A, an elevational view shows attachment portion 122 folded or wrapped over anchor member 190. As shown in FIG. 5A, attachment portion 122 may be secured to itself by wrapping with wire or string 199 after folding or wrapping attachment portion 122 over anchor member 190. In other embodiments as illustrated in FIG. 5B, anchor member 190 is a nail or the like that pierces attachment portion 122 of cloth member 120. In such an embodiment, attachment portion 122 is optionally also wrapped with string 199 prior to or after inserting anchor member through attachment portion 122. Prior to piercing attachment portion 122, attachment portion 122 may be folded or bunched together to engage more layers of attachment portion 122.

Figure 6:
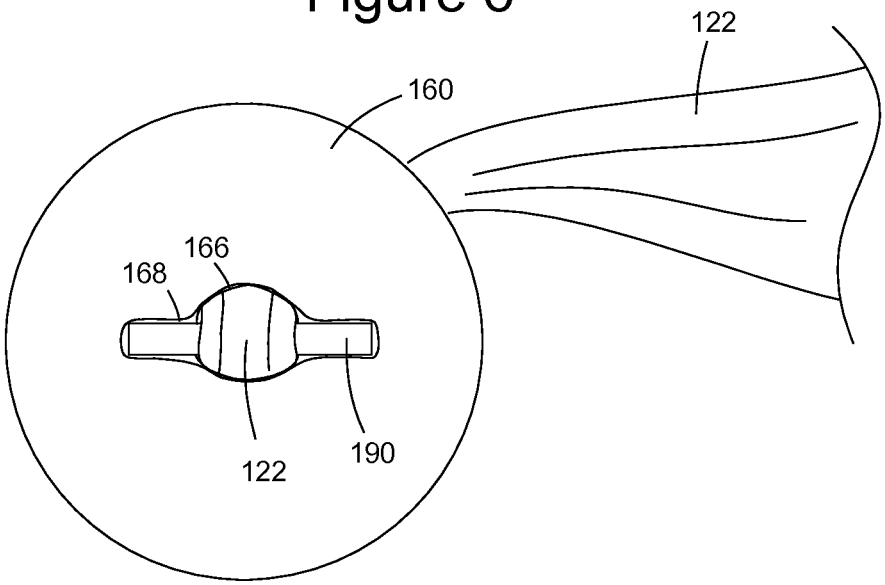
FIG. 6 illustrates an elevational view of the ball core shown with the cloth member attached to the anchor member, where the anchor member is seated in the anchor recess.
Figure 6A:
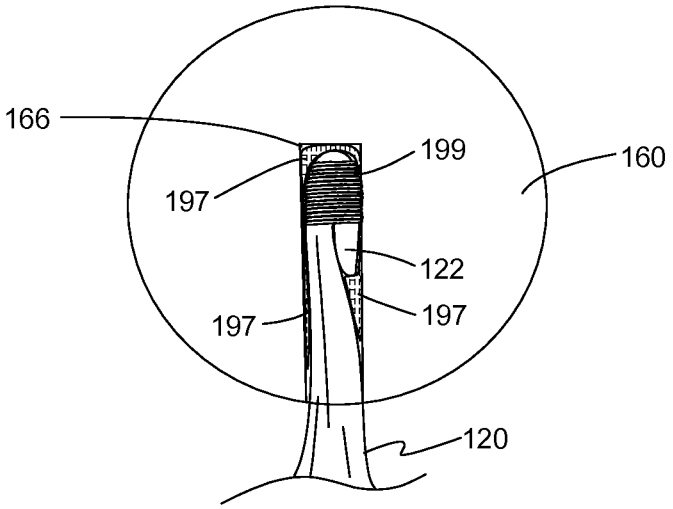
FIG. 6A illustrates a section of a ball core showing the attachment portion of the cloth member fixed into a bore into the core with adhesive after being wrapped with string.

FIG. 6 illustrates cloth member 120 secured to ball core 160. Attachment portion 122 is wrapped around anchor member 190 with anchor member 190 being seated in anchor recess 168. Optionally, a piece of cloth tape (not shown) may be added over anchor recess 168 to smooth the area before cover material 114 is installed. FIG. 6A illustrates a sectional view of another embodiment in which attachment portion 122 is wrapped with string 199 and secured into bore 166 with adhesive 197. In such an embodiment, bore 166 is typically a blind bore extending approximately to the center of the ball. In one embodiment, string 199 is wrapped about 50 times around attachment portion 122. Adhesive 197 functions as anchor member 190 to retain attachment member in bore 166.

Figure 7A:
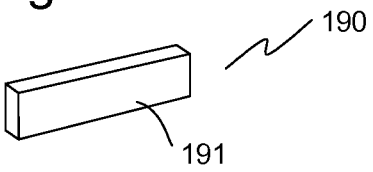
FIGS. 7A-7H & 7J illustrate perspective views of exemplary embodiments of anchor recesses of the present invention.
Figure 7B:
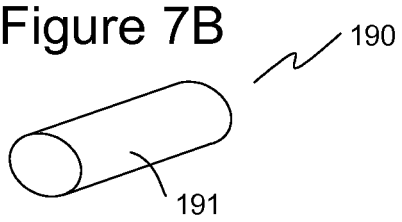
Figure 7C:
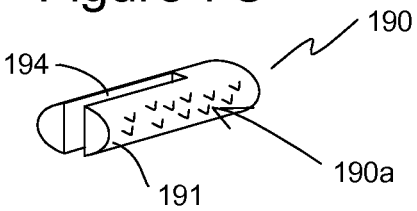
Figure 7D:
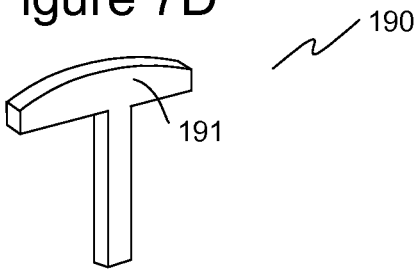
Figure 7E:
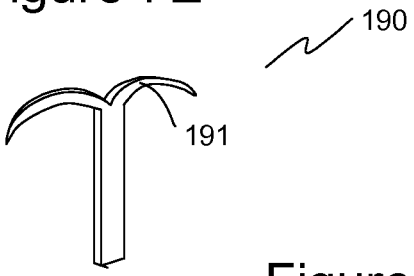
Figure 7F:
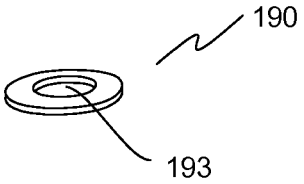
Figure 7G:
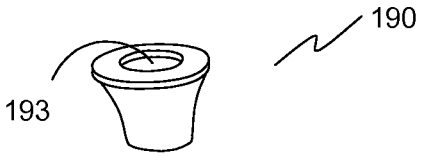
Figure 7H:
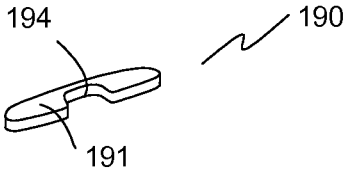
Figure 7J:
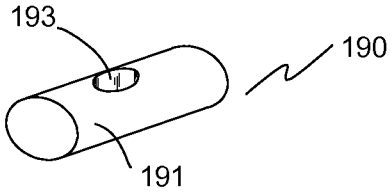

Referring now to FIGS. 7A-7H and 7J, examples of anchor member 190 are illustrated. Anchor member 190 may be a bar (FIG. 7A), a rod (FIG. 7B), a cleat (FIG. 7C), T-shaped member (FIG. 7D), a hook or anchor hook (FIG. 7E), a flat washer (FIG. 7F), a plug (FIG. 7G), or other structure (FIG. 7H) to which cloth member 120 may be attached. As shown in FIGS. 7C, 7F-7H, and 7J, anchor member 190 in some embodiments includes an opening 193 or slot 194 to engage cloth member 120. When anchor member 190 is a washer or plug as illustrated in FIGS. 7F-7G, respectively, attachment portion 122 of cloth member 120 (shown, e.g., in FIGS. 2A-2B & 3) may be inserted through opening 193 and then knotted to prevent its passage back through opening 193. In one embodiment, anchor member 190 is a flat bar or cylindrical rod, such as illustrated in FIGS. 7A-7B, and sized to extend across bore 166 and seat in anchor recess 168. For example, anchor member 190 is a metal bar or rod with a diameter of 2 mm and length of 12 mm.

As shown in FIG. 7C, anchor member 190 optionally includes a gripping outside surface 190*a*, such as protrusions or texture to engage and grip cloth member 120. Whatever the geometry of anchor 190, it has a dimension that prevents or may be positioned to prevent passage of anchor member 190 through bore 166, thereby anchoring cloth member 120 to ball core 160.

Figure 8:
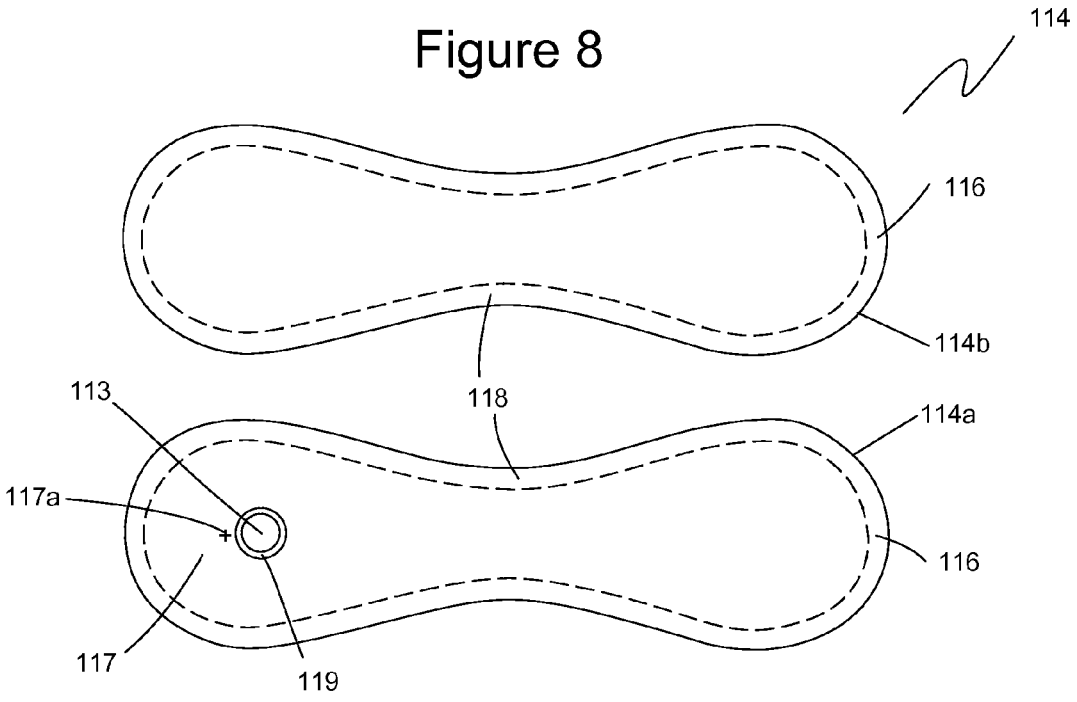
FIG. 8 illustrates a plan view of one embodiment of a cover member of the present invention, where the cover member includes a first cover member portion and a second cover member portion.

Referring now to FIG. 8, one embodiment of cover material 114 is illustrated in a plan view. Consistent with a traditional regulation baseball, one embodiment of cover material 114 includes a first cover portion 114*a* and a second cover portion 114*b*, each of which generally has an oval shape with rounded ends 116 and a narrowed waist portion 118. When wrapped around ball core 160 and stitched together with rounded end 116 of first cover portion 114*a* abutting waist portion 118 of second cover portion 114*b* in a transverse orientation, first and second cover portions 114*a*, 114*b* combine to cover ball core 160. In one embodiment, cover portion 114 is made of leather and has cotton string stitching to secure first cover portion 114*a* to second cover portion 114*b* as in a traditional baseball. In one embodiment, cover material 114 is assembled with 96 tight, consistent stitches. These material choices simulate the look, feel, and texture of a regulation baseball. Other materials, shapes, and methods of assembling cover material 114 are acceptable.

First cover portion 114*a* includes cover opening 113 approximately centered on end portion 117 of first cover portion 114*a*. As illustrated, cover opening 113 is a hole; however, cover opening 113 may be a slit, cut, or opening of another shape that permits cloth member 120 to exit from ball 110. In one embodiment, cover opening 113 is a hole centered widthwise, but is offset ¼" from end 116 compared to true center 117*a* of end portion 117. When assembled as shown in FIG. 1, cover opening 113 is positioned over a bore 166 through core 160. For comfort, visual appeal, and to prevent damage to cover material adjacent cover opening 113, an optional grommet 119 or the like may be installed in cover opening 113. In one embodiment, grommet 119 has an outer diameter of 16.5 mm and opening with diameter of about 10-12 mm.

In one embodiment, ball core 160 has a diameter of about 55 mm and bore 166 has a diameter of about ½" (12 mm). This size of ball core 160 results in ball 110 being smaller than a regulation ball, which typically has a diameter of 75 mm. After installing cover material 114, ball 110 has a circumference of about 7.5 inches (190 mm) and a diameter of about 60 mm. Compared to a regulation baseball, this smaller size allows the user to better grip the ball 110 by covering more of the ball with the user's fingers and palm. This smaller size of ball 110 also helps reduce strain and fatigue in the hand, wrist, forearm, elbow, and shoulder, by not requiring the user to grip the ball so tightly, especially for young players.

The mass of ball 110 is also reduced compared to a regulation baseball, which is between about 142-148 grams. In one embodiment, ball core 160, cover material 114, and anchor 190 together weigh about 80 grams. Complete with a 51 gram cloth member 120, the total weight of training device 100 is about 131 grams. The lighter weight compared to a regulation baseball helps reduce strain on the user's arm. When the force of the aerodynamic drag (a variable value) due to cloth member 120 is added to the force needed to move the ball's weight, the resulting combination of forces is self-adjusting to the user based on varying throwing motions and throwing speeds of the user.

It is contemplated within the scope of this invention that some embodiments of training device 100 have ball 110 that is heavier and/or larger than a regulation baseball. In yet other embodiments, cloth member is larger or smaller than described above as needed to achieve the desired aerodynamic resistance. For example, large and strong players may wish to train with an embodiment of training device 10 that includes a ball 110 heavier than a regulation ball and/or cloth member 120 significantly larger than the 12"×20" size discussed above.

In use, the user of training device 100 grips ball 110 with opening 113 facing away from the user's hand. With the ball held this way, cloth member 120 extends through opening 113 and forward of the user's hand. A right handed user typically will hold the index finger extending along the curved part of the stitching at rounded end 116 of one of the cover members 114*b*. The user's middle finger will extend transversely between the two parallel seams along the narrowed waist 118 of the cover member 114*b*. A left handed user would rotate the ball 180 degrees for an equivalent grip. Other grips may be used as deemed appropriate by the user, such as a grip suited for throwing a fast ball or changeup pitch. The user holds training device 100 while moving the hand and arm through a typical throwing motion without releasing ball 110 from the user's grip. Since the user is not throwing a regulation baseball, which is larger and heavier, the lighter and smaller ball 110 may help avoid strain and excessive wear on the arm.

The user's throwing motion with training device 100 typically is consistent with a pitching motion, but it may also replicate a regular baseball throw as well. Accordingly, a user of any size and skill level may develop and improve proper throwing and pitching technique, reinforce proper throwing mechanics, and improve arm speed and follow through. Training device 100 may also be used to strengthen and increase endurance in the user's arm through repetitive, practiced motions. Due to the minimal aerodynamic drag produced by cloth member 120, arm strain may be reduced as the user moves his/her arm at the user's own pace.

Embodiments utilizing a smaller and lighter ball 110 compared to a regulation baseball have found that the arm is not fatigued as quickly. Using training device 100 helps pitchers improve accuracy and consistency by observing cloth member 120 to indicate throwing paths, direction, distance, reach, and general mechanics. These indications are greatly beneficial for pitchers, but training device 100 helps any player improve throwing mechanics and technique.

Training device 100 encourages the user to reach out and extend the arm during the pitching or throwing motion as well as to focus on the length of the user's stride. In some cases the user intends to hit or slap cloth member 120 against a fixed object such as a fence, a wall, a chair, a baseball bat, or glove held in front of the user, or any other object positioned to require the user to reach to make cloth member 120 contact the object. Training device 100 reduces risk of injury by promoting a good follow through. A good follow through prevents an early release of the ball and over rotation of the arm, both of which strain the elbow and shoulder.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

The invention claimed is:

1. A sports training device for pitching and throwing comprising:

a ball core having a substantially spherical shape and defining a passageway extending through the ball core from a first side to a second side opposite the first side, wherein the ball core defines an anchor recess in a surface of the second side of the ball core and extending transversely to and communicating with the passageway;

an anchor member having a longitudinal portion received in the anchor recess and extending across and beyond the passageway;

a cloth member having a geometric shape defining an attachment portion and a body portion extending away from the attachment portion and having at least one corner, wherein the attachment portion extends through the passageway from the first side and loops over the anchor member;

a length of wire or string wrapped around the attachment portion of the cloth member adjacent the anchor member; and a cover material having a cover opening, the cover material disposed over the ball core with the cover opening opposite of the anchor recess and aligned over the passageway wherein the body portion of the cloth member extends out through the passageway and cover opening;

wherein the anchor member fixedly secures the attachment portion of the cloth member to the ball core.

2. The sports training device of claim 1, wherein the attachment portion wraps around the longitudinal portion of the anchor member and a part of the attachment portion is fixedly attached to another part of the attachment portion.

3. The sports training device of claim 2, wherein the anchor member is selected from the group consisting of a rod, a bar, a hook, and a T.

4. The sports training device of claim 1, wherein the attachment portion extends through an anchor member opening defined in the anchor member.

5. The sports training device of claim 1, wherein the cloth member is made of cotton denim and has an area between about 230 and 250 square inches.

6. The sports training device of claim 1, wherein the ball core with attached cover material has a circumference of about 7.5 inches.

7. The sports training device of claim 1, wherein the training device has a weight less than 140 grams.

8. The sports training device of claim 1, wherein the attachment portion of the cloth member is one of the at least one corner of the cloth member.

9. The sports training device of claim 1, wherein the attachment portion of the cloth member is a length of material extending from the body portion.

10. A method of making a sports training device comprising:

providing a ball core, a cloth member having an attachment portion and a body portion, an anchor member, and a cover member with a cover opening;

defining a passageway through the ball core from a first side to a second side opposite the first side;

defining an anchor recess in the surface of the second intersects the passageway;

inserting the attachment portion of the cloth member through the passageway in the ball core;

attaching the attachment portion to the anchor member by wrapping a length of wire or string around the attachment portion adjacent the anchor member;

seating the anchor member in the anchor recess with the attachment portion attached thereto, with the anchor member extending across the passageway, and with the body portion of the cloth member extending out through the passageway away from the ball core; and installing the cover member over the ball core, wherein the body portion of the cloth member extends out through the cover opening;

wherein the anchor member fixedly secures the attachment portion of the cloth member to the ball core.

11. The method of claim 10, wherein attaching the attachment portion to the anchor member comprises:

selecting the attachment portion as a corner portion of the cloth member;

wrapping the attachment portion around the anchor member; and securing the attachment portion to itself.

12. The method of claim 11, wherein the corner portion is selected to include a cloth strip extending across the corner portion, and wherein the step of wrapping the attachment portion around the anchor member includes positioning the anchor member between the cloth strip and the corner portion.

13. The method of claim 10, wherein the providing step includes selecting the anchor member from one of a bar, a rod, a T, and a hook.

14. The method of claim 10, wherein the providing step includes selecting the cloth member to be made of cotton denim and having an area from about 230 to about 250 square inches.

15. The method of claim 14, wherein the cloth member extends from the ball core by about 18 to 22 inches.

16. The method of claim 10, further comprising:

inserting the attachment portion through a grommet;

inserting the attachment portion through an opening defined in the cover member; and installing the grommet in the opening.

17. The method of claim 10, wherein the providing step includes selecting the ball core and the cover member to result in a circumference of about 7.5 inches when the cover member is installed on the ball core.

18. The method of claim 10, wherein the step of installing the cover member comprises:

selecting a cover comprising a cover member first portion and a cover member second portion, wherein the cover member first portion defines the cover opening;

inserting the attachment portion through the cover opening prior to the step of inserting the attachment portion through the passageway;

aligning the opening over the passageway and opposite of the anchor recess; and stitching together the cover member first portion to the cover member second portion, thereby forming a substantially continuous cover over the ball core.

19. The method of claim 10, wherein the providing step includes selecting the ball core, the cloth member, the anchor member, and the cover member to result in an assembled weight of less than 140 grams.

* * * * *